US010449557B2

(12) United States Patent
Hursen

(10) Patent No.: US 10,449,557 B2
(45) Date of Patent: Oct. 22, 2019

(54) SUPERSONIC AIR KNIFE WITH A SUPERSONIC VARIABLE FLOW NOZZLE

(71) Applicant: Thomas Francis Hursen, Allison Park, PA (US)

(72) Inventor: Thomas Francis Hursen, Allison Park, PA (US)

( * ) Notice: Subject to any disclaimer, the term of this patent is extended or adjusted under 35 U.S.C. 154(b) by 161 days.

(21) Appl. No.: 15/651,201

(22) Filed: Jul. 17, 2017

(65) Prior Publication Data

US 2018/0015486 A1 Jan. 18, 2018

Related U.S. Application Data

(60) Provisional application No. 62/362,702, filed on Jul. 15, 2016.

(51) Int. Cl.

| | |
|---|---|
| ***B05B 1/00*** | (2006.01) |
| ***B05B 1/30*** | (2006.01) |
| ***B05B 1/12*** | (2006.01) |
| ***E02F 3/92*** | (2006.01) |
| ***E02F 3/02*** | (2006.01) |
| ***E21C 25/60*** | (2006.01) |
| *E02F 5/10* | (2006.01) |
| *E21B 7/18* | (2006.01) |

(52) U.S. Cl.

CPC ..... *B05B 1/005* (2013.01); *B05B 1/12* (2013.01); *B05B 1/30* (2013.01); *B05B 1/3073* (2013.01); *E02F 3/02* (2013.01); *E02F 3/925* (2013.01); *E21C 25/60* (2013.01); *E02F 3/9206* (2013.01); *E02F 5/107* (2013.01); *E21B 7/18* (2013.01)

(58) Field of Classification Search

CPC ..... B05B 1/3073; B05B 1/12; B05B 1/005; B05B 1/30; E02F 3/02; E02F 3/925; E21C 25/60

USPC ..... 239/152, 436–438, 451, 456, 288–288.5, 239/532, 589, DIG. 21, DIG. 22

See application file for complete search history.

(56) References Cited

U.S. PATENT DOCUMENTS

| | | | | |
|---|---|---|---|---|
| 2,320,964 | A * | 6/1943 | Yates | B05B 1/005 239/DIG. 22 |
| 3,599,876 | A | 8/1971 | Kyburg | |
| 3,647,142 | A | 3/1972 | Drude et al. | |
| 3,672,575 | A | 6/1972 | Hinrichs | |
| 3,743,186 | A | 7/1973 | Mocarski | |
| 3,774,847 | A | 11/1973 | Malec | |
| 3,790,084 | A | 2/1974 | Kinsley | |
| 3,790,085 | A | 2/1974 | Ayer | |

(Continued)

*Primary Examiner* — Steven J Ganey

(74) *Attorney, Agent, or Firm* — Blynn L. Shideler; Krisanne Shideler; BLK Law Group

(57) ABSTRACT

A hand held supersonic air knife with a supersonic variable flow nozzle yields a continuously variable power mass flow rate (CFM) and pressure over a selectable power range, responsive to rotations of the nozzle exterior sleeve or outer nozzle member. The maximum power position identified as one end position and a second end position as the lowest power. The exterior sleeve can be rotated to any axial or circumferential position between start (low) and end (high). The result will be an intermediate power position. Any intermediate position will also be a supersonic nozzle of varying parameters between the start and end positions. Thus, a variable flow supersonic nozzle is provided by the manual sleeve rotation by an operator or a remotely controlled positioning of the sleeve.

11 Claims, 5 Drawing Sheets

(56) References Cited

U.S. PATENT DOCUMENTS

| | | | | |
|---|---|---|---|---|
| 4,025,045 | A | 5/1977 | Kubiak | |
| 4,026,474 | A | 5/1977 | Knauer et al. | |
| 4,243,178 | A | 1/1981 | Self | |
| 4,813,611 | A | 3/1989 | Fontana | |
| 5,170,943 | A | 12/1992 | Artzberger | |
| 5,212,891 | A | 5/1993 | Schuermann et al. | |
| 5,285,965 | A | 2/1994 | McCutcheon et al. | |
| 5,782,414 | A * | 7/1998 | Nathenson | E21B 7/18 239/532 |
| 6,158,152 | A * | 12/2000 | Nathenson | B08B 5/02 239/532 |
| 8,171,659 | B2 | 5/2012 | Hursen | |
| 2003/0041484 | A1* | 3/2003 | Russo | E02F 3/9206 37/335 |
| 2015/0298154 | A1* | 10/2015 | Morgan | B05B 15/16 239/288.5 |

* cited by examiner

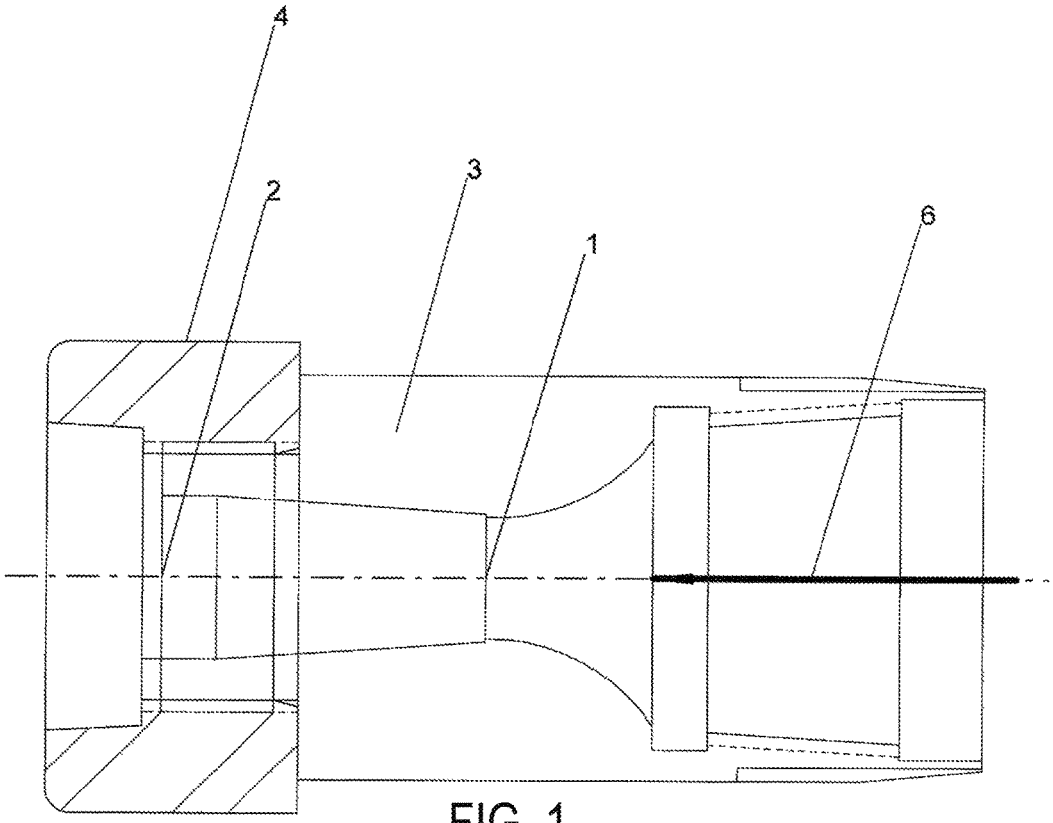
FIG. 1
PRIOR ART
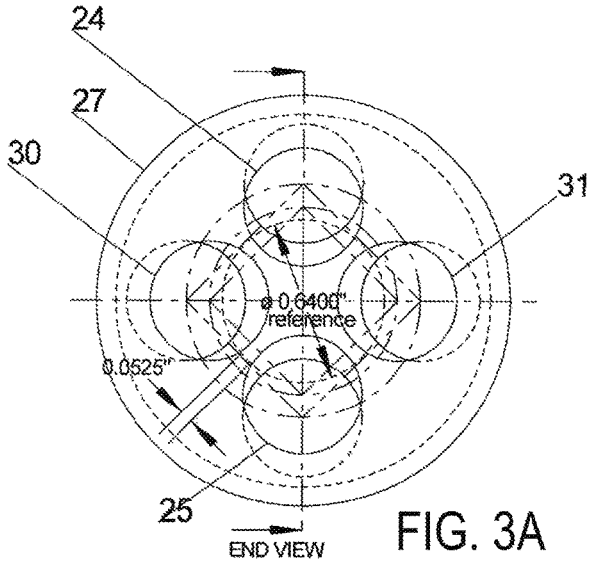
FIG. 3A
FIG. 3B
| | | psi | Rcfm | Dcfm |
|---|---|---|---|---|
| DIA. 1 | 0.763 | 90 | 91 | 81 |
| DIA. 2 | 0.740 | | | |
| DIA. 4 | 0.634 | | | |
| DIA. 5 | 0.508 | 90 | 375 | 333 |

SUPERSONIC NOZZLE WITH STRAIGHT SURFACE (external) AND CONTOURED (internal) SURFACES SUPERSONIC NOZZLE WITH CONTOURED (external) AND CONTOURED (internal) SURFACES

VARIABLE SUPERSONIC NOZZLES

VARIABLE SONIC NOZZLES

SUPERSONIC AIR KNIFE WITH A SUPERSONIC VARIABLE FLOW NOZZLE

RELATED APPLICATIONS

This application claims priority to U.S. patent application Ser. No. 62/362,702 filed Jul. 15, 2016, entitled "Supersonic Variable Flow Nozzle" which application is incorporated herein by reference in its entirety.

BACKGROUND INFORMATION

1. Field of the Invention

The present invention relates to supersonic variable flow nozzles, more particularly a supersonic air knife with a supersonic variable flow nozzle.

2. Background Information

The present invention relates generally to air knives, and more specifically to the supersonic air knife with a supersonic variable flow nozzle.

Air Knife Technology

In a conventional air knife associated with the present invention, compressed air, typically 90 to 100 psi, is converted to a supersonic jet while flowing through a nozzle especially designed for the purpose. The maximum jet velocity that can be achieved is determined by the pressure available from the compressor. Exit velocities in the range of Mach 1.6 to Mach 1.7 are typical for most portable compressors. Since the determining limit on Mach number for the exiting jet stream is the available pressure, higher Mach numbers can only be achieved by using higher compressor pressures. The air stream is initially the same diameter as the nozzle exit because the emerging jet stream diameter is the same as the nozzle exit diameter. For this reason, some refer to this characteristic as being laser-like. But as soon as the stream leaves the nozzle, it expands concentrically, since it is surrounded by atmospheric air.

High speed video of convention supersonic air knives shows the rapid expansion, but these videos also show that this high velocity air penetrates the ground to a depth of about a foot, creating a momentary cavity of about a foot in diameter, in which the dirt is crumbled. As the jet leaves that location or the air blast is ended, the dirt falls back on itself if the tool barrel is held close to the vertical. However, if the air knife barrel is inclined away from the user, the dirt can be blasted out the ground to a depth of one to two feet, depending upon technique. Since buried pipes, cables and tree roots are not porous the air knife use does not damage these elements, yet the dirt is removed from these structures. This aspect makes air knives quite popular for excavation of pipes and cables and for minimizing damage to ornamental trees, additionally it can be used by emergency responders for digging out people or animals in select circumstances.

For further details see regarding air knife technology and use see the inventors prior U.S. Pat. No. 8,171,659 entitled "Method and apparatus for selective soil fracturing, soil excavation or soil treatment using supersonic pneumatic nozzle with integral fluidized material injector;" and U.S. Pat. No. 8,171,659 entitled "Air Gun Safety Nozzle" which patents are incorporated herein by reference. U.S. Pat. Nos. 5,782,414, 5,212,891, 5,170,943, 4,813,611 all disclose related excavating pneumatic nozzle designs that are of interest and these are incorporated by reference as background. Representative examples of earlier air gun designs are shown in U.S. Pat. Nos. 3,599,876, 3,647,142, 3,672,575, 3,743,186, 3,774,847, 3,790,084, 3,790,085, 4,025,045, 4,026,474, 4,243,178, and 5,285,965 which are also incorporated herein by reference. From this prior art it can be seen that supersonic air knives are also referenced as compressed air guns, air blow guns, air jet guns, and a variety of similar terms. These will be referenced as supersonic air knives or air knives within this application.

The construction and operation of conventional air knives is known from the above cited prior art. As discussed briefly above air knives with supersonic nozzles have been used for many purposes, including safe digging in the earth to locate buried objects for examination, repair, removal, or adding new underground connections in many industries. The features or characteristics of operation of the air knives as yielded a growing number of applications.

Thus far, the applications of air knives on and in the ground have been with fixed nozzles of a fixed design that are ideally matched to a single specific source compressor model. Thus such nozzles are not variable in the field to suit either other compressor models or the variable demands of various applications. For example, consider the application of the removal and transplantation of a medium to large size tree. A source compressor of large size and power is usually required to do the task efficiently, but the usual nozzle required is too powerful for the smaller roots and the usual nozzle may and likely will damage and cut those roots. Similar situations occur in other applications such as collapse trench rescue where large air power is useful to dig towards the victim quickly but less power is required when digging closer to, or directly against the victim.

This invention is particularly useful for supersonic air knives and addresses the problems of the prior art providing a supersonic variable flow nozzle for an air knife.

SUMMARY OF THE INVENTION

This invention is directed to a cost effective, efficient, and easy to implement supersonic variable flow nozzle for supersonic air knives. Technically the present invention is a supersonic, sonic or subsonic nozzle with a continuously variable power and corresponding mass flow rate (CFM) and pressure i.e. air power: over a selectable power range, responsive to rotations of the nozzle exterior sleeve, the maximum power position identified as one end position and a second end position as the lowest power. The lowest power nozzle design point can be specified as such or as another specific CFM/PSI combination, responsive to rotations of the nozzle exterior sleeve and identified as a start position. The exterior sleeve can be rotated to any axial or circumferential position between start (low) and end (high). The result will be an intermediate power position. Any intermediate position will also be a supersonic nozzle of varying parameters between the start and end position. Thus, in a sense a "dial a supersonic nozzle" is provided by the present invention. The invention may be a manual sleeve rotation by an operator or a remotely controlled automated positioning of the sleeve.

This concept of the present invention can be applied to a hypersonic rocket nozzle (with automatic rotation) for improved thrust efficiency during atmospheric launch.

One embodiment of the present invention provides a complete nozzle or nozzles consisting of one or more sets of related partial nozzle structures or components in series on a first element, with a spatial relationship to a second element containing complementary partial nozzle structures, the partial nozzle structures of the first element related by a fixed or variable value to the partial nozzle structures mounted on the second element, the elements in rotative and axial relationship to each other, such that complete nozzles are formed by the cooperative positioning of the first element to the second element.

One aspect of the invention provides A hand-held supersonic air knife comprising: a source of compressed air providing compressed air at least at one given pressure; a hand-held variable flow nozzle coupled to the source of compressed air, wherein the variable flow nozzle includes: i) An inner nozzle member, and ii) An outer nozzle member which combines with the inner nozzle member to define an annular throat for the compressed air to flow through and achieve supersonic flow, wherein the outer nozzle member is axially movable relative to the inner nozzle member to adjust the cross-sectional area of the annular throat.

The hand-held supersonic air knife according to the invention may provide that the source of compressed air provides air at a range of air pressures and wherein distinct positions of the outer nozzle member relative to the inner nozzle member are associated with an annular throat area optimized for a given air pressure within the range of air pressures of the source of compressed air.

The supersonic air knife according to one aspect of the invention provides that one surface of the inner nozzle member and the outer nozzle member which forms the annular throat is a straight surface and the other is a non-linear contoured surface.

The supersonic air knife according to one aspect of the invention provides that the outer nozzle member is threaded to the inner nozzle member to provide the axial movement of the outer nozzle member is axially movable relative to the inner nozzle member.

The supersonic air knife according to one aspect of the invention provides that the inner nozzle member includes a plurality of inner nozzle passages configured to conduct air into an annulus space upstream of the annular throat.

The supersonic air knife according to one aspect of the invention provides that the outer nozzle member includes an outer wear tip coupled to a distal end thereof.

One aspect of the invention may be defined as a variable flow nozzle configured for being coupled to a source of compressed air which provides air at a range of air pressures, wherein the variable flow nozzle comprises: An inner nozzle member, and An outer nozzle member which combines with the inner nozzle member to define an annular throat for the compressed air to flow through and achieve supersonic flow, wherein the outer nozzle member is axially movable relative to the inner nozzle member to adjust the cross-sectional area of the annular throat, and wherein distinct positions of the outer nozzle member relative to the inner nozzle member are associated with an annular throat area optimized for a given air pressure within the range of air pressures of the source of compressed air.

These and other aspects of the present invention will be clarified in the description of the preferred embodiment of the present invention described below in connection with the attached figures in which like reference numerals represent like elements throughout.

BRIEF DESCRIPTION OF THE DRAWINGS

The enclosed drawings illustrate some practical embodiments of the present invention, without intending to limit the scope of the invention or the included claims.

FIG. 1 is a cross section elevational side view of a typical commercial prior art supersonic nozzle which is available and designed by the applicant.

FIG. 3A is a schematic upstream end view from the air flow into the supersonic variable flow nozzle of an air knife of FIGS. 2A-B.

FIG. 3B is a chart of five effective diameters of the supersonic variable flow nozzle of an air knife of FIGS. 2A-B and the range of operating parameters at the extremes;

FIGS. 5A and B compares a supersonic variable flow nozzle of an air knife of the present invention with a sonic variable flow nozzle of an air knife of the present invention in which FIG. 5A is a schematic sectional side view of the supersonic variable flow nozzle of an air knife of FIGS. 2A-B, schematically showing start low flow position and the end, max flow position of the present invention and in which

BRIEF DESCRIPTION OF THE PREFERRED EMBODIMENTS

FIG. 1 is a commercially available supersonic nozzle. The internal nozzle dimensions are fixed and sized to be powered by a specific, large commercial source compressor whose output is specified by the source compressor rating or performance in psig (pounds per square Inch) and CFM (Cubic Feet per Minute). The nozzle elements are the commercial nozzle throat area 1 and the commercial nozzle exit area 2. The commercial nozzle body is 3 and a renewable or replaceable wear tip 4 is included. Commercial nozzle air flow direction 6 is indicated. The internal straight lines in the nozzle illustrate the general design and should be assumed to be smoothly blended when machined.

Figure 2A:
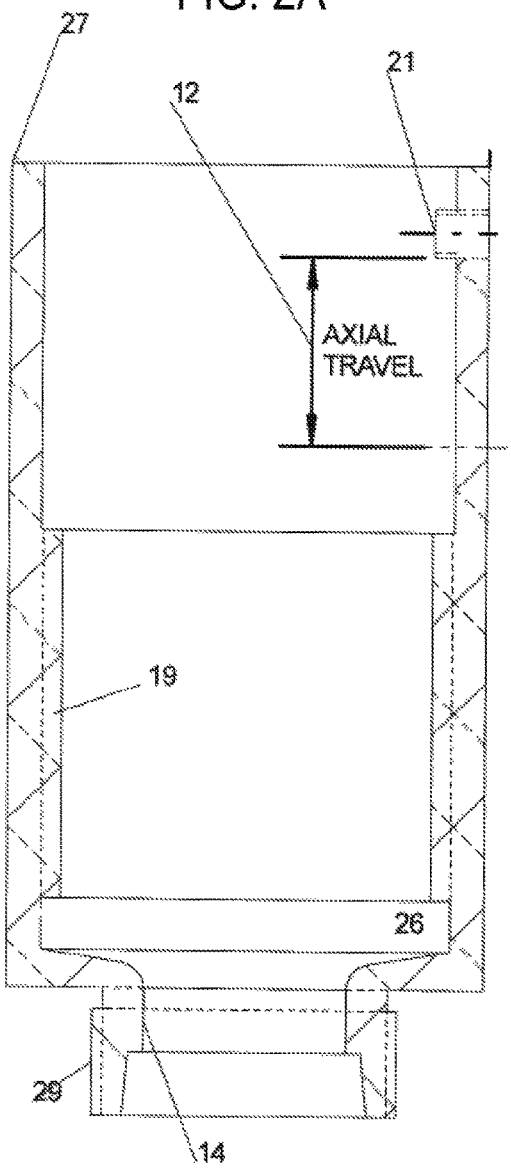
FIGS. 2A and B are sectional side views collectively illustrating the two components forming the supersonic variable flow nozzle of an air knife according to one embodiment of the present invention.
Figure 2B:
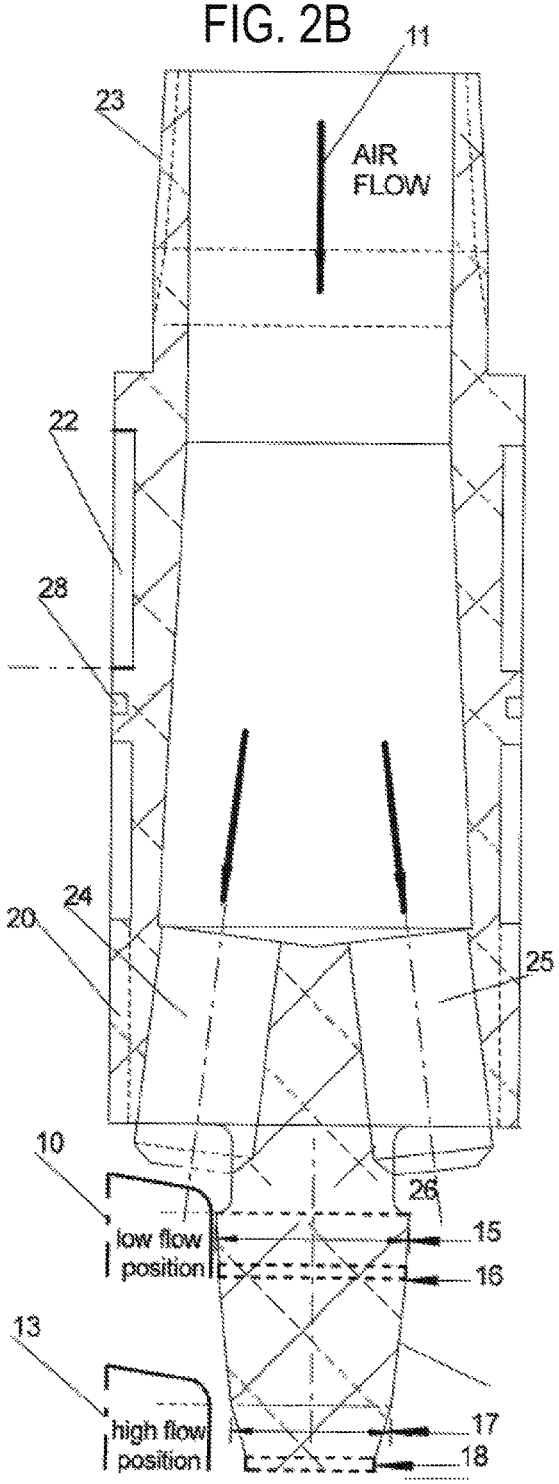

FIGS. 2A and B are sectional side views collectively illustrating the two components forming the hand-held supersonic variable flow nozzle of a hand held supersonic air knife according to one embodiment of the present invention, wherein the two major parts shown not assembled for clarity and are shown in one correct axial position relative to the other. It is the axial position of minimum power and flow. FIG. 2A is the outer nozzle component or outer nozzle member or outer sleeve. FIG. 2B is the inner nozzle component or inner nozzle member. The two nozzle components or members are shown aligned with each other in the low flow position 10 of straight surface 14. The inlet air flow direction 11 is indicated. As discussed further below, the outer nozzle member combines with the inner nozzle member to define an annular throat for the compressed air to flow through and achieve supersonic flow, wherein the outer nozzle member is axially movable relative to the inner nozzle member to adjust the cross-sectional area of the annular throat.

The maximum axial travel 12 is indicated, which is how far down the outer nozzle component or outer nozzle member of FIG. 2A can move relative to the inner nozzle component or inner nozzle member of FIG. 2B to reach the high flow position 13 of straight surface 14. The straight surface 14 defines an axial outer or distal surface of the outer nozzle component in any axial position and the inner surface of the inner nozzle component at the low flow position 10 is defined as the inner nozzle diameter 15 and inner nozzle diameter 16.

A smooth and appropriate transitional geometry must connect within each of the two diameters which with the straight surface form two area sets or annular throat areas of one supersonic nozzle. The relative position of the outer nozzle component of FIG. 2A to the inner nozzle component of 2B is determined by rotation of the outer nozzle engaged thread 19 on inner nozzle engaged threads. The outer nozzle component of FIG. 2A as shown can only move down the figure, being restrained from motion up the figure by the locating pin 21 within the travel undercut 22 in the inner nozzle component of FIG. 2B.

The low flow position 10 is the position of the lowest nozzle flow, the lowest airpower setting and is preferably the start position, being the safest. The (end) high flow position 13 of the straight surface 14 relative to the inner nozzle component is the position of the highest nozzle flow, the highest air power setting and the end position. In this position the straight surface 14 is still the outer definition of the nozzle, but now the inner nozzle diameter 17 and the inner nozzle diameter 18 form the inside of this supersonic nozzle.

The high flow position 13 and geometry is selected to match the source compressor operation at its maximum operating output power, cfm and psi. This sets diameter 17 and diameter 18 in cooperation with straight surface 14.

As before, where straight lines are used to illustrate internal nozzle shapes, the reader should assume terminations of such lines are smoothed in transition at each end. Furthermore, the slope of these lines are selected to be suitable for an efficient supersonic nozzle.

Each increment of position change down the page is an increase in mass flow rate and power and is a different supersonic nozzle.

An O-ring 28 prevents extraneous loss of air pressure to the atmosphere. The nozzle straight surface 14 of the nozzle component of FIG. 2A is farther from the device center line than the complementing diameters or shapes of the cooperating nozzle component of FIG. 2B. This arrangement is preferred but the opposite is feasible. For example, the nozzle shapes on the straight surface 14 and the corresponding surfaces on the internal nozzle component of 2A may be contoured to achieve specific performance objectives.

The tapered thread 23 connects the nozzle to the air source. The inner nozzle passage 24 and inner nozzle passage 25 conduct a portion of the incoming air flow into the annulus 26.

For protection from mechanical impact of the central nozzle surface against the ground, and from blow back to the nozzle that could wear those important surfaces, a protecting wear tip may be used similar to the wear tip 4 in FIG. 1 but would be attached to the outer nozzle component of 2A at the outer nozzle thread 29.

There are an infinite number of variations of internal and outer nozzle shapes and combinations. In the preferred embodiment for the hand held air knife tool as shown the start position corresponds to a small compressor rating, however the existing compressor rating of greater power is selected at the end position than the power of the start position. This allows an existing, readily available source compressor to power this hand held and hand manipulated nozzle over the full range of the variable nozzle. Further, the operator of the hand held tool is not constrained to select whole numbers of outer nozzle rotations, except at the start and end positions.

FIG. 3A is a schematic upstream end view from the air flow into the supersonic variable flow nozzle of an air knife of FIGS. 2A-B illustrating the near ends of inner nozzle passages 24, 25, 30 and 31 which conduct air into the annulus 26. The outer nozzle exterior wall 27 of the nozzle component of in FIG. 2A is shown as it would appear if the two nozzle components were assembled.

The nozzle components in the start position and the end position have been calculated with appropriate supersonic nozzle calculations. FIG. 3B shows the nozzle ratings selected for the prototype device and two intermediate ratings that resulted from two and four rotations of the outer nozzle. A total of six rotations from the start position would have resulted in the (end) high flow position 13.

Figure 4A:
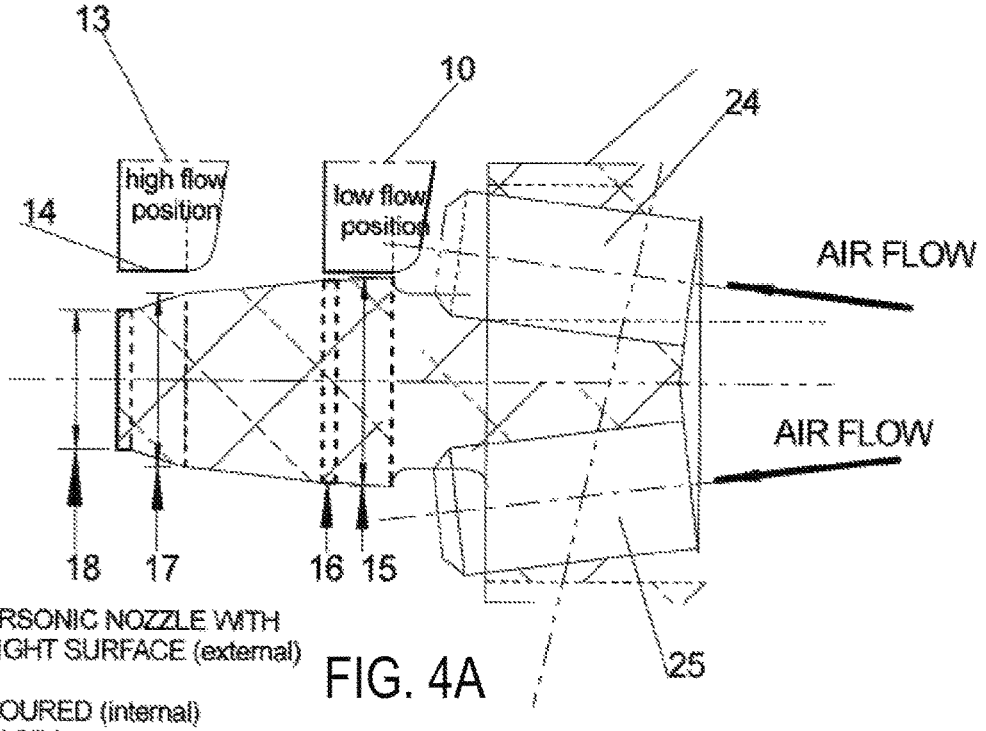
FIG. 4A is a schematic sectional side view of the supersonic variable flow nozzle of an air knife of FIGS. 2A-B, schematically showing start low flow position and the end, max flow position of the present invention.

FIG. 4A is a schematic sectional side view of the supersonic variable flow nozzle of an air knife of FIGS. 2A-B, schematically showing start low flow position and the end, max flow position of the present invention. FIG. 4A repeats the inner and outer nozzle elements from FIG. 2A and FIG. 2B repeating the numbered identifications including the straight surface 14.

Figure 4B:
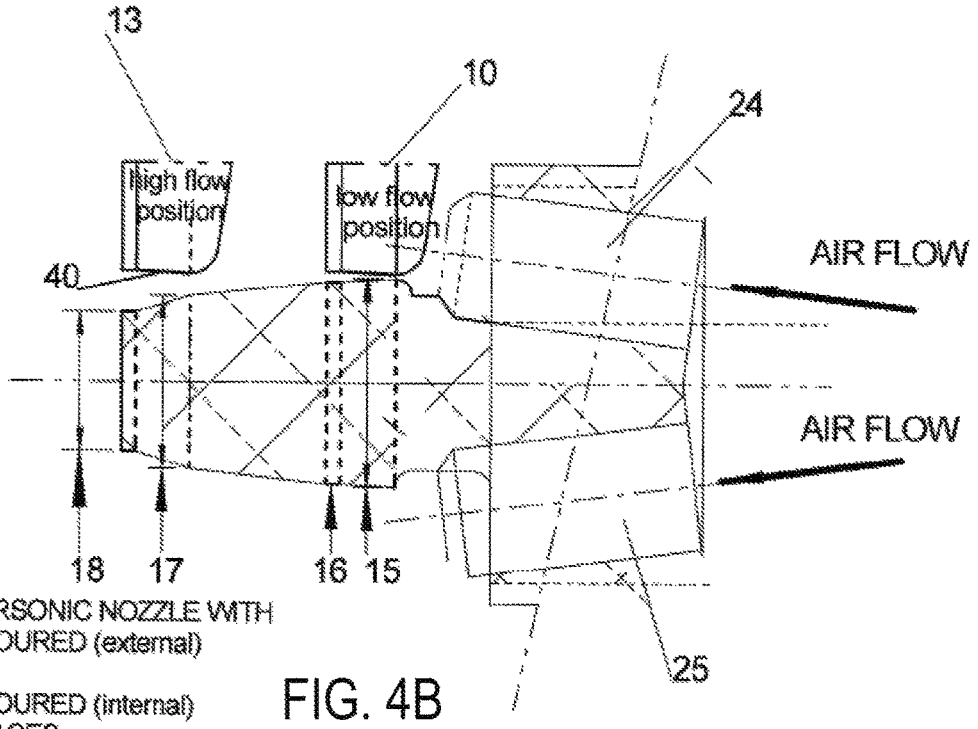
FIG. 4B is a schematic sectional side view of a modified supersonic variable flow nozzle of an air knife according to another embodiment of the present invention, schematically showing start low flow position and the end, max flow position of the present invention.

FIG. 4B is a schematic sectional side view of a modified supersonic variable flow nozzle of an air knife according to another embodiment of the present invention, schematically showing start low flow position and the end, max flow position of the present invention. FIG. 4B repeats FIG. 4A except that the straight surface 14 has been replaced with a contoured surface 40. While a strait surface 14 was selected for the preferred embodiment many optional contours are available for many different supersonic nozzle purposes.

Figure 5A:
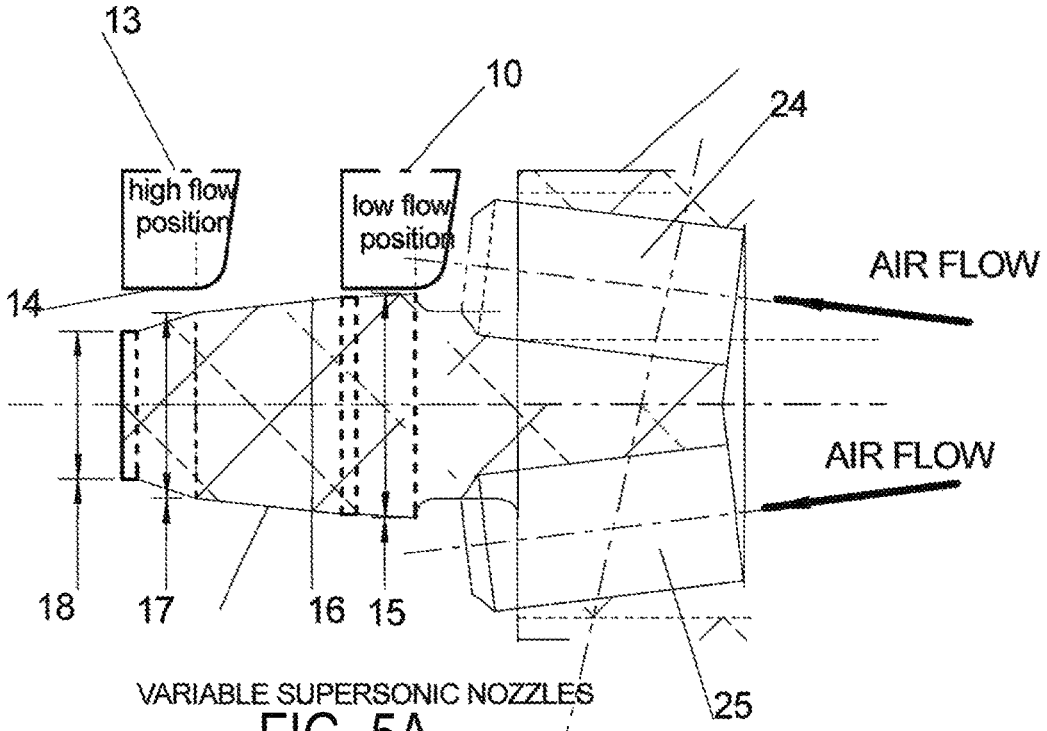
Figure 5B:
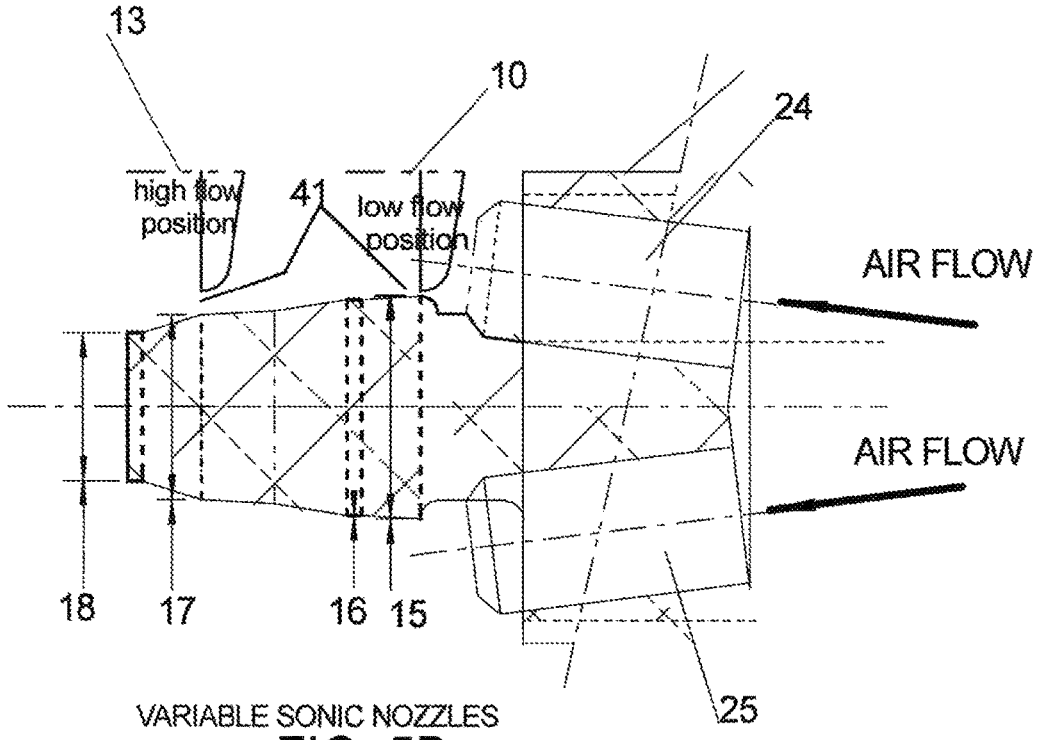
FIG. 5B is a schematic sectional side view of the sonic variable flow nozzle of an air knife of a modified embodiment of the present invention.

FIGS. 5A and B compares a supersonic variable flow nozzle of an air knife of the present invention with a sonic variable flow nozzle of an air knife of the present invention in which FIG. 5A is a schematic sectional side view of the supersonic variable flow nozzle of an air knife of FIGS. 2A-B, schematically showing start low flow position and the end, max flow position of the present invention and in which FIG. 5B is a schematic sectional side view of the sonic variable flow nozzle of an air knife of a modified embodiment of the present invention. FIG. 5B illustrates a sonic nozzle option and it is noted that for such a sonic design the straight surface 14 of FIG. 5A does not exist beyond the throat 41 so there is no controlled smooth transition of flow beyond the sonic nozzle throat 41 that is required to produce a supersonic nozzle.

Figure 6:
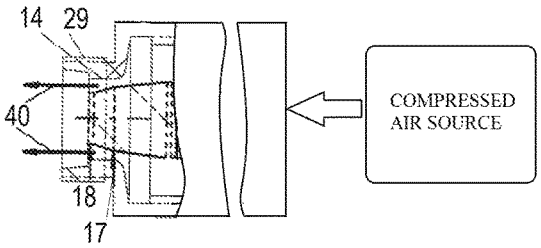
FIG. 6 is a schematic partially in section of a supersonic air knife with a variable flow nozzle of FIGS. 2A-B.

FIG. 6 is a schematic partially in section of a supersonic air knife with a variable flow nozzle of FIGS. 2A-B showing the coupling to a source of compressed air, namely a compressor. Visible reference marks or lines can be made on the visible inner nozzle component exterior to mark the complete power range or increments thereof.

The following discussion concerns internal nozzle flow momentum elements of the various nozzle designs discussed herein. Existing supersonic nozzles for current digging applications are generally similar to FIG. 1 and in that they produce a central axis jet which implies turbulent random direction momentum flow elements within the fluid. Conversely the preferred embodiment of FIGS. 2A and B is a circumferential jet arrayed about a central axis but not through the central axis. This configuration has the benefit of concentrating some of the otherwise normally random momentum flow elements of the nozzle of FIG. 1 into a circumferential momentum concentrating nozzle which will improve digging performance for the hand tool of the present invention.

Figure 7A:
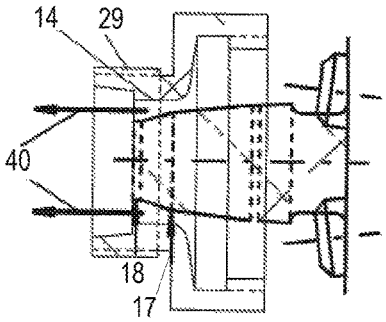
FIGS. 7 A and B are schematic views of a digging nozzle according to one embodiment of the present invention and a (hypersonic) rocket nozzle formed according to the principles of the present invention.
Figure 7B:
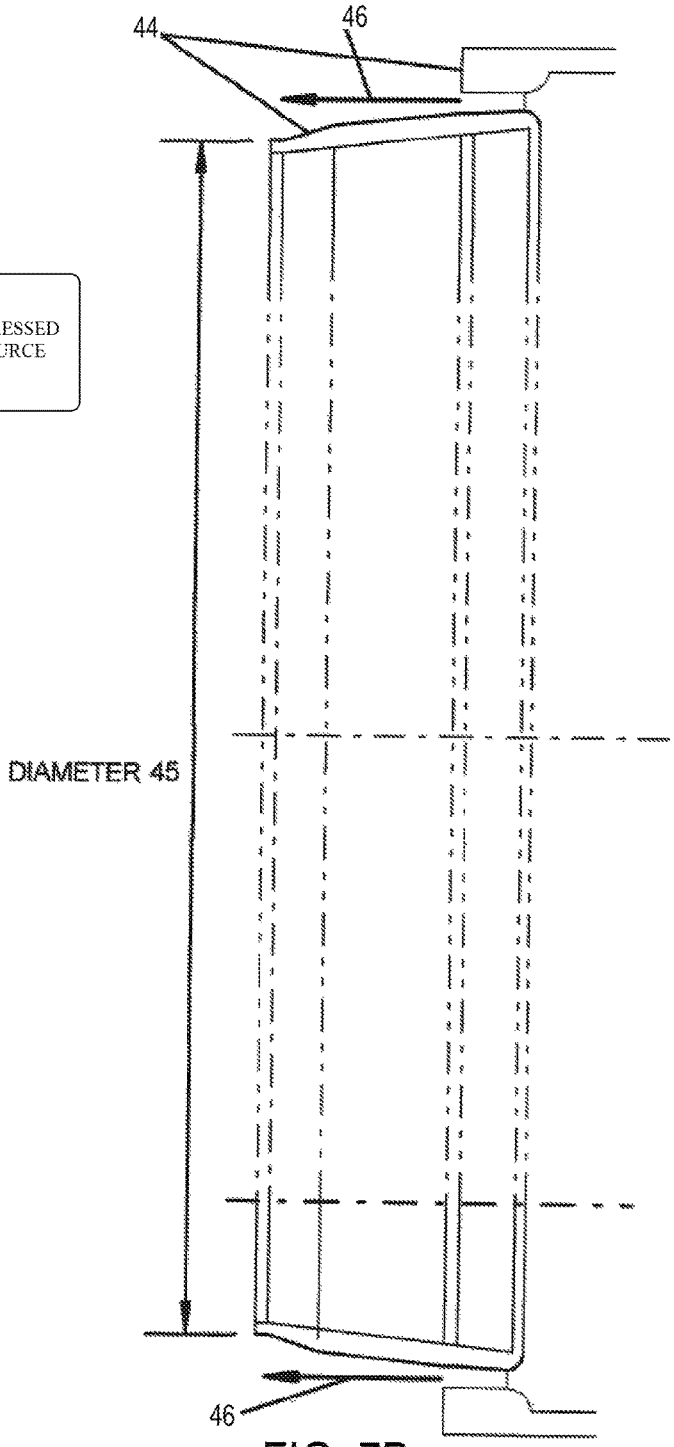

FIGS. 7 A and B are side by side schematic comparisons of a digging nozzle according to one embodiment of the present invention and a (hypersonic) rocket nozzle formed according to the principles of the present invention. As suggested in FIG. 7B, if the concept of FIGS. 2 A and B of the present invention is grossly enlarged in diameter and combined with a suitable fuel system, combustion chamber, ignition system, control system, and programmable nozzle adjustment mechanism to adjust the nozzle throat area and the nozzle exit area individually, this makes it an altitude adjustable, circumferential momentum concentrating rocket nozzle type. This is a rocket engine. This continuous adjustable capability of the exit area can be programmed to match the expected variation in the local exit atmospheric variation with altitude during a rocket launch so as to improve thrust efficiency as the rocket rises through the atmosphere headed for space. The separate capability to adjust the throat area is a further opportunity to optimize fuel efficiency during launch. FIGS. 7 A and B compares a supersonic hand tool digging nozzle FIG. 7A to a (hypersonic) rocket nozzle FIG. 7B. The physical size comparison does not quite do justice to the enormous diameter that is possible in the rocket nozzle, namely 18 to 30 feet in diameter, or larger. The rocket engine exit diameter 45 is only suggested but note that the high temperature gas discharge 46 from the rocket nozzle 44 occurs near the rocket nozzle O.D. This greatly benefits the circumferential momentum concentrating in the exiting thrust. And note that the nozzle throat and the nozzle exit geometry can be individually defined and adjusted, similar to the smaller digging nozzle.

As detailed above the invention provides a hand-held supersonic air knife comprising a source of compressed air shown in FIG. 6 providing compressed air at least at one given pressure; a hand-held variable flow nozzle coupled to the source of compressed air, wherein the variable flow nozzle includes: i) An inner nozzle member, and ii) An outer nozzle member which combines with the inner nozzle member to define an annular throat for the compressed air to flow through and achieve supersonic flow, wherein the outer nozzle member is axially movable relative to the inner nozzle member to adjust the cross-sectional area of the annular throat.

The hand-held supersonic air knife according to the invention may provide that the source of compressed air provides air at a range of air pressures and wherein distinct positions of the outer nozzle member relative to the inner nozzle member are associated with an annular throat area optimized for a given air pressure within the range of air pressures of the source of compressed air.

The supersonic air knife according to one aspect of the invention provides that one surface of the inner nozzle member and the outer nozzle member which forms the annular throat is a straight surface and the other is a non-linear contoured surface.

The supersonic air knife according to one aspect of the invention provides that the outer nozzle member is threaded to the inner nozzle member to provide the axial movement of the outer nozzle member is axially movable relative to the inner nozzle member.

The supersonic air knife according to one aspect of the invention provides that the inner nozzle member includes a plurality of inner nozzle passages configured to conduct air into an annulus space upstream of the annular throat.

The supersonic air knife according to one aspect of the invention provides that the outer nozzle member includes an outer wear tip coupled to a distal end thereof.

It is apparent that many variations to the present invention may be made without departing from the spirit and scope of the invention. The present invention is defined by the appended claims and equivalents thereto.

What is claimed is:

1. A hand-held supersonic air knife comprising:

A source of compressed air providing compressed air at least at one given pressure;

A hand-held variable flow nozzle coupled to the source of compressed air, wherein the variable flow nozzle includes:

i) An inner nozzle member having radial faces of decreasing diameters from a proximal to a distal end of the inner nozzle member, and ii) An outer nozzle member having a constant diameter radial face which combines with selective radial faces of the inner nozzle member to define an annular throat for the compressed air to flow through and achieve supersonic flow, wherein the outer nozzle member is axially movable relative to the inner nozzle member to adjust the cross-sectional area of the annular throat by aligning the constant diameter radial face of the outer nozzle member with selective radial face of the inner nozzle member.

2. The supersonic air knife according to claim 1, wherein the source of compressed air provides air at a range of air pressures and wherein distinct positions of the constant diameter radial face of the outer nozzle member relative to selective radial faces of the inner nozzle member are associated with an annular throat area optimized for a given air pressure within the range of air pressures of the source of compressed air.

3. The supersonic air knife according to claim 2, wherein the outer nozzle member is threaded to the inner nozzle member to provide the axial movement of the outer nozzle member is axially movable relative to the inner nozzle member.

4. The supersonic air knife according to claim 3, wherein the inner nozzle member includes a plurality of inner nozzle passages configured to conduct air into an annulus space upstream of the annular throat.

5. The supersonic air knife according to claim 4, wherein the outer nozzle member includes an outer wear tip coupled to a distal end thereof.

6. The supersonic air knife according to claim 1, wherein the outer nozzle member is threaded to the inner nozzle member to provide the axial movement of the outer nozzle member is axially movable relative to the inner nozzle member.

7. The supersonic air knife according to claim 6, wherein the inner nozzle member includes a plurality of inner nozzle passages configured to conduct air into an annulus space upstream of the annular throat.

8. The supersonic air knife according to claim 7, wherein the outer nozzle member includes an outer wear tip coupled to a distal end thereof.

9. The supersonic air knife according to claim 1, wherein the outer nozzle member includes an outer wear tip coupled to a distal end thereof.

10. A variable flow nozzle configured for being coupled to a source of compressed air which provides air at a range of air pressures, wherein the variable flow nozzle comprises:

An inner nozzle member having radial faces of decreasing diameters from a proximal to a distal end of the inner nozzle member, and An outer nozzle member having a constant diameter radial face which combines with selective radial faces of the inner nozzle member to define an annular throat for the compressed air to flow through and achieve supersonic flow, wherein the outer nozzle member is axially movable relative to the inner nozzle member to adjust the cross-sectional area of the annular throat, and wherein distinct positions of the constant diameter radial face of the outer nozzle member relative to selective radial faces of the inner nozzle member are associated with an annular throat area optimized for a given air pressure within the range of air pressures of the source of compressed air.

11. The variable flow nozzle according to claim 10, wherein the outer nozzle member is threaded to the inner nozzle member to provide the axial movement of the outer nozzle member is axially movable relative to the inner nozzle member.

* * * * *